United States Patent [19]

Memeger, Jr.

[11] Patent Number: 4,515,656

[45] Date of Patent: May 7, 1985

[54] LOW DENSITY NONWOVEN SHEETS

[75] Inventor: Wesley Memeger, Jr., Wilmington, Del.

[73] Assignee: E. I. Du Pont de Nemours and Company, Wilmington, Del.

[21] Appl. No.: 406,543

[22] Filed: Aug. 9, 1982

Related U.S. Application Data

[63] Continuation-in-part of Ser. No. 297,271, Aug. 28, 1981, abandoned.

[51] Int. Cl.[3] ..... D21F 11/00

[52] U.S. Cl. ..... 162/101; 162/108; 162/146; 162/206; 428/72; 428/109; 428/156; 428/172; 428/178; 428/247; 428/255

[58] Field of Search ..... 162/146, 157.2, 101, 162/202, 100, 206, 201, 108; 428/166, 156, 72, 172, 178, 109, 245, 255, 247; 156/77, 78

[56] References Cited

U.S. PATENT DOCUMENTS 2,999,788 9/1961 Morgan .
3,101,294 8/1963 Fridricksen .
3,375,156 3/1968 Edgar .
3,756,908 9/1973 Gross .
3,759,775 9/1973 Shepherd .
3,880,705 4/1975 Tilburg .

OTHER PUBLICATIONS

Research Disclosure, May 1973, p. 101, Item 10947.
Du Pont Technical Information Bulletin NX-5, (Dec. 1976).

*Primary Examiner*—Peter Chin

[57] ABSTRACT

Coherent expanded nonwoven sheets having a density of less than 0.16 g/mL are comprised of fibrids of a wholly synthetic polymer, preferably not melting below 130° C., and optionally containing up to 80% by weight floc. The sheet is comprised of a plurality of paper-like membranous layers which join and separate at random throughout the thickness of the sheet to form expanded cells. The expanded nonwoven sheets are prepared by rapid vaporization of water in a wet, never-dried sheet of fibrids containing at least 60% by weight water. Rapid vaporization of the water preferably is induced by dielectric heating. Embossing may be used before or during expansion to produce a sheet which is expanded only in selected areas.

35 Claims, 3 Drawing Figures

LOW DENSITY NONWOVEN SHEETS

CROSS-REFERENCE TO RELATED APPLICATION

This application is a continuation-in-part of my copending application Ser. No. 297,271 filed Aug. 28, 1981 and now abandoned.

DESCRIPTION

1. Technical Field

This invention relates to coherent, expanded, wet-laid nonwoven sheets comprised of wholly synthetic polymer fibrids and optionally short length fibers. The sheets are suitable for use as thermal and acoustical insulation having a low density.

2. Background Art

Wet-laid nonwoven sheets comprised of wholly synthetic polymeric fibrids and short length staple fibers are known from U.S. Pat. No. 2,999,788. Increased bonding of these sheets can be obtained by application of heat and/or pressure. Pressure can be applied with engraved rolls which produce a pattern on the sheets. Dielectric heating may be used to increase bonding in the sheets. The sheets are paper-like or cloth-like, depending on the materials used. Typical densities are of the order of 0.4–0.6 g/mL. While these sheets are said to be useful in acoustical insulation, a lower density material could provide better acoustical and thermal insulation properties at a lower cost. Somewhat lower density sheets can be obtained in uncalendered form. For instance, an uncalendered aramid paper sheet is available commercially having a density of about 0.3 g/mL; but even lower density sheets of such materials would be more useful in many applications if they could be made economically and free of undesirable contaminants.

Low density nonwoven sheets are prepared according to U.S. Pat. No. 3,759,775 (Re: 30,061) by impregnating a nonwoven web with an aqueous liquid containing a binder and rapidly vaporizing the water, e.g., by dielectric heating, to expand the structure while simultaneously setting the binder. The nonwoven webs are preferably air-laid.

Expanded fibrous material may be prepared according to British Pat. No. 1,408,262 by confining the fibrous material under pressure with a puffing agent, preferably with heating, followed by release of the pressure and expansion of the material. The heat may be provided by dielectric means.

The solvent, heat and flame-resistant properties of synthetic aramids, such as poly[m-phenylene isophthalamide], which make them very useful under certain conditions, also make it especially difficult to fabricate the polymers into a useful expanded low-density form. This invention provides among other things a novel process for making such polymers into lightweight structures.

One object of this invention is a coherent sheet comprised of wholly synthetic polymer fibrids and having a density of less than 0.16 g/mL (10 lbs/ft$^3$). Another object is a paper-making process for providing such a low density sheet from wholly synthetic polymer fibrids by wet-laying, without needing any adhesive binder, and especially when the fibrids are of an aramid.

BRIEF DESCRIPTION OF THE INVENTION

This invention provides a coherent expanded nonwoven sheet comprised of fibrids of a wholly synthetic polymer and optionally up to 80% by weight of short fibers or floc, the sheet having an apparent density (as defined herein) of less than 0.16 g/mL, and being comprised of a plurality of paper-like layers lying substantially horizontally in the plane of the sheet which join and separate at random throughout the thickness of the sheet to form expanded macroscopic cells. The paper-like layers are comprised of membranous elements which are comprised of the fibrids.

This invention further provides a coherent expanded nonwoven sheet comprised of fibrids of a wholly synthetic polymer which fibrids form a multiplicity of layered membranous elements which join with and separate from one another at random to form a three-dimensional, highly irregular network of numerous interleaved macroscopic cells with tapered edges positioned substantially throughout the thickness of the expanded sheet.

In a typical cell cross section the maximum width of the cell, usually running in a direction substantially parallel to the plane of the sheet, is considerably greater than its maximum height at right angles thereto, usually, for example, by a factor of at least 2. Because of the manner in which the cells are formed, by separation and joining of the layered membranous elements, frequently the edges of a cell as shown by cross section are substantially tapered with respect to a thicker inner portion of the cell.

In addition to the fibrids, the sheet can contain up to 80% by weight of short fibers, i.e., floc, based on the total weight of fibrids and fibers; preferably less than 70% fibers, and more preferably 20–50% fibers. The type and quantity of fibers to be used depend upon the strength and other physical properties desired in the sheet as taught, for example, in U.S. Pat. No. 3,756,908, the specification of which is incorporated herein by reference.

The sheet can be expanded completely, i.e., entirely throughout its length and width as well as thickness; but as a preferred embodiment discrete portions of the sheet remain unexpanded, e.g., portions arranged in a random or, more preferably, patterned manner about its surface area. Most preferably since embossing limits expansion even in unembossed regions, no more than 50% of the sheet, based on total surface area, is not expanded according to this invention.

The fibrids are comprised of a synthetic fiber-forming polymer having sufficient heat resistance to survive the sheet expanding process, as described hereinafter, i.e., without substantial loss of shape and integrity through fusing or decomposition. The floc must be heat resistant likewise. Since flashing steam from rapidly evaporating water is the preferred expanding medium, the fibrids and the floc preferably should not melt or decompose below about 130° C. for best results.

The expanded sheets of the invention do not require any, and preferably do not contain, adhesive binder material for structural integrity; but small quantities of such materials are not necessarily excluded, provided they do not interfere with the fibrid membrane formation, which forms the expanded cell structure, or with other desired properties. Preferably no adhesive binder material is used and the sheet then is considered as "adhesive-free" and consists essentially of the fibrids and of any short fibers as described above, allowing, of course, for minor amounts of conventional nonstructural additives such as pigments, dyes, chemical stabilizers and so forth.

This invention provides expanded nonwoven sheets of "apparent" densities of less than 0.16 g/mL and preferably less than 0.10 g/mL. When the sheet is completely expanded throughout to a uniform thickness, its actual and "apparent" densities are theoretically the same.

Thicknesses of the expanded regions more than five times greater than those of any unexpanded regions e.g., due to embossing, can be achieved. For even lighter weight material, expansion to a thickness ten times that of the embossed thickness is achievable.

Preferably the fibrids are comprised of an aromatic polyamide, more specifically an aramid, and most preferably poly(m-phenylene isophthalamide). Preferably the floc also is comprised of an aromatic polyamide, most preferably poly(m-phenylene isophthalamide) or poly(p-phenylene terephthalamide). In another preferred embodiment, the floc is comprised of glass fibers.

This invention also provides a process for preparing a coherent expanded nonwoven sheet comprising preparing a wet mixture with water of 20–100% by weight fibrids of a wholly synthetic polymer and 0–80% by weight floc, complementally to total 100% and both as described hereinbefore, forming a wet nonwoven sheet of the mixture on paper-forming equipment, maintaining water in the formed sheet and preferably at at least 40% by weight, adding additional water, if needed, to increase the water content of the sheet to at least 60% by weight, and heating the wet sheet to vaporize the water rapidly and to expand the sheet to provide a product having an apparent density of less than 0.16 g/mL. The expansion is accompanied by the formation of macroscopic cells as described hereinbefore.

Up to 50% of the total area of the sheet can be embossed before or during expansion to provide a sheet which is expanded only in selected areas. Preferably the wet nonwoven sheet contains 20–80% by weight fibrids and complementally 20–80% by weight floc; more preferably less than 70% fibers; and most preferably 50–80% by weight fibrids and 20–50% by weight floc to a total of 100%, all on a dry basis. As used herein percentages are by weight unless otherwise specified. Preferably the fibrids are comprised of an aromatic polyamide, most preferably poly(m-phenylene isophthalamide). Preferably the floc is comprised of an aromatic polyamide, most preferably poly(m-phenylene isophthalamide) or poly(p-phenylene terephthalamide). Fibers of the latter most preferably are pulped, i.e., macerated as described hereinafter. Most preferably the rapid vaporization of water is induced by dielectric heating.

The low-density sheets of this invention are especially useful for providing thermal and/or acoustical insulation. When they are composed of materials known for good flame retardance (e.g., poly[m-phenylene isophthalamide], poly[p-phenylene terephthalamide], poly[vinylidene fluoride], or glass) they are particularly useful in aircraft and so forth where flame retardance and lightness of weight are important. Such flame-retardant sheets are also useful as inner liners of textile goods such as protective clothing; and they may be impregnated with resins to form low-density composite rigid structures useful, for example, in floors and walls of aircraft.

DETAILED DESCRIPTION OF THE INVENTION

Figure 1:
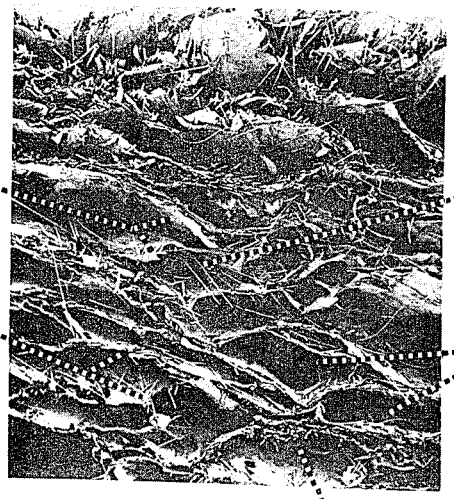
FIG. 1 is an enlarged cross-sectional view of an expanded nonwoven sheet of the invention.

Nonwoven sheets suitable for use in the process of the present invention are conveniently prepared as taught in U.S. Pat. No. 2,999,788 from synthetic polymeric fibrids prepared by shear precipitation of solutions of the polymer, preferably into an aqueous medium. The fibrids should not be isolated but rather are directly converted into sheet structures by the usual paper-forming techniques. Preferably, the aqueous mix used to prepare the nonwoven sheets by paper-making methods will contain short staple fibers (floc) in addition to the fibrids. Other materials may be added if desired.

The as-formed wet sheets must not be fully dried before expansion. Preferably for better and more uniform expansion they should never be dried to a water content of less than 40% and more preferably no less than 60% before expansion, particularly for fibrids of MPD-I. Good expansion requires a water content of at least 60%; therefore, if the water content is less than 60%, additional water should be added to the sheet before expansion. If desired, the sheet may be saturated with water before expansion. Additional water may be added either before or after any embossing step.

The term "floc" is used to describe short length fibers as customarily used in the preparation of wet-laid sheets. Floc suitable for use in this invention will normally have lengths less than 2.5 cm, most preferably about 0.68 cm. Linear density is from 0.55 to 11.1 or more dtex, more preferably in the range 1.0 to 3.5 dtex. In the examples, unless indicated otherwise, the floc employed was of poly(m-phenylene isophthalamide) fibers with a linear density of 2.2 dtex and a cut length of about 0.68 cm. While suitable floc can be prepared from filaments which have not been fully drawn and/or heat-stabilized (crystallized), it is preferred that the floc be cut from highly drawn and heat-stabilized filaments. Such floc provides maximum strength and resistance to shrinkage of resultant sheets. Both synthetic polymeric and inorganic flocs may be used.

Floc which has been "pulped" is also suitable either alone or as any part of the total floc. Pulping results upon maceration of floc to shatter the fiber and generate fibrous elements of irregular shape comprising numerous fine fibrils. Pulping is conveniently achieved using a well-known double-disc wet-refiner.

Fibrids are very small, nongranular, flexible, fibrous or film-like particles. At least one of their three dimensions is of minor magnitude relative to the largest dimension. They are prepared by precipitation of a solution of the fibrid-material using a non-solvent under very high shear, as is known. Suitable fibrids and methods for their preparation are described in U.S. Pat. No. 2,999,788 issued Sept. 12, 1961, to P. W. Morgan. Fibrids are always prepared as dispersions in liquid. They can be converted to aqueous slurries by suitable washing techniques. For use according to the teachings of this invention, fibrids must not be dried or heated above their glass-transition temperature before being fed to a paper-making machine. If dried, redispersion is difficult and effectiveness in this invention is greatly reduced if not destroyed. If heat-set, the flexibility required for good performance is severely diminished. Fibrids characteristically have a high absorptive capacity for water and when deposited on a screen have sufficient strength even when wet to permit processing on a paper machine.

Where fibrids of poly(m-phenylene isophthalamide) (MPD-I) are involved in the examples, they are prepared essentially as in the following specific method. A solution at about 120° C. containing about 14% by weight of MPD-I and having a viscosity between 5 and 7.5 Pascal-seconds (an inherent viscosity of about 1.6) is passed to a fibridator of the type disclosed in U.S. Pat. No. 3,018,091. The solution contains 77.5% dimethylacetamide, 2% water, and 6.5% $CaCl_2$ (all percentages by weight). The polymer solution is fed to the fibridator at approximately 550 kg of solids per hour. The precipitant liquid is fed at 15°–20° C. to the fibridator and controlled to contain from 30–40% dimethylacetamide, 58–68% water, and about 2% $CaCl_2$ all to total 100% (all percentages by weight). Flow-rate of precipitant to the fibridator is about 28.4 kg per kg of polymer solution. A rotor speed of about 7000 rpm generates the shear required to produce fibrids of good papermaking quality. The fibrids are washed with water until the residual contents of dimethylacetamide and chloride are each about 0.5% by weight or less, based on the polymer. The fibrids are then refined to improve their filmy characteristics using a disc-refiner at 0.8% consistency to provide a Schopper Riegler Freeness of 300–400 mL. Using the Clark Fiber Classification (TAPPI Standard T-233 su-64), a typical fibrid size characterization is:

| Screen size, mesh | % Retained |
|---|---|
| 14 | 1.0 |
| 30 | 8.0 |
| 50 | 38.0 |
| 100 | 34.0 |
| Total | 81.0 |

Suitable sheets for use herein can be made by uniformly depositing an aqueous slurry of the paper-making fibrous material onto a foraminous surface (e.g., a fine-mesh screen or fabric) through which much of the water quickly drains to form an initial sheet. Sheets prepared one at a time on laboratory-scale paper-forming equipment are designated "handsheets". The laboratory-scale paper-forming machine used to make handsheets as described in some of the examples was provided with a headbox for receiving fibrous slurry, a 20×20 cm (8.0×8.0 in) drainage screen, and a vacuum provision below the screen to assist in removing water.

The detailed procedure for preparing a specific handsheet comprising 57 wt % fibrid and 43 wt % floc is given below. Handsheets of different fibrid/floc ratios and of different fibrid and/or floc materials were prepared analogously, specific forming quantities being provided in the Examples.

An aqueous slurry oomposed of 40 g of the MPD-I fibrids and 460 g of water was added to a blender containing 3000 g of water. Then 30 g of dry MPD-I floc was added and the mixture blended for 30 min. To 1000 mL of this mixture was added 2000 mL of water, and the second mixture was blended for 15 min. A 1200 mL aliquot of the second mixture was poured into the headbox of a laboratory-scale paper-forming machine containing a 1.3 cm head of water. After removal of water by application of water-jet vacuum for 25 sec, the handsheet was pulled from the screen. It retained about 88 wgt. % water and weighed 205 g/m$^2$. Repetition of the procedure except that only a 600 mL aliquot of the second mixture was used yielded a handsheet weighing 119 g/m$^2$.

The wet fibrid/floc papers, before or during expansion, may be embossed. By "embossing" is meant the application of pressure in a patterned array of pressure-points such that, upon expansion, the pressed areas do not expand significantly. Such embossing limits the expansion obtainable in the unembossed areas because of the continuity of fibrous materials from embossed to unembossed areas. Embossing, however, imparts a degree of rigidity and durability in use which exceeds that of expanded sheet products not embossed prior to or during expansion. Because of the limited expansion for embossed sheet products, no more than about 50% of the surface area of the sheet should be embossed.

Embossing surfaces may be in a variety of known forms, generally either flat plates or preferably paired driven rolls with a pattern of protrusions. Tests have revealed that one-sided embossing against a plain surface as well as two-sided embossing between mated patterns can be used. It is obvious that similar results are obtainable with two-sided embossing between mismatched patterns whereby compressed areas result only when protuberances on both sides mate at the embossing nip. While the pressure required to produce enough compaction at embossed areas to prevent expansion on heating depends to a minor extent on the fibrid-material involved, it has been found that about 10 MPa (1500 psi) on the embossed area, and preferably about 24 MPa (3500 psi), is suitable.

Dielectric expansion of both embossed and unembossed sheets is shown in the examples. Unless otherwise designated, the "diamond-embossed" sheets were pressed between mated sheets of expanded metal webbing having a pattern of diamond-shaped openings defined by two sets of linear strips of metal parallel to one another in each set and intersecting with no increase in thickness set-to-set. Also, unless otherwise designated, the linear metal strips were 2.5 mm (0.10 in) wide and defined diamond shaped openings with 2.54 cm (1.0 in) and 0.76 cm (0.30 in) major and minor axes. "Plain-embossed" designates patterned arrays of embossing by discrete protrusions spaced in square array. In the examples, unless otherwise stated, "plain embossed" indicates square protrusions 0.13 cm (0.05 in) on each side spaced so their centers are in square array 0.445 cm (0.175 in) on each side. It is apparent that any geometric array of embossing elements may be employed.

When the never-dried fibrid/floc sheet is heated rapidly enough, water-vapor is generated at such a high rate that the sheet expands in thickness, except at suitably embossed areas. Preferably the sheet is heated by passing through a dielectric field of sufficient intensity. The available frequencies of dielectric energy generally vary from about 13 MHz up to about 2450 MHz but only certain discrete frequencies in this range are generally permitted by the various countries. The selection of a frequency depends most significantly on the width of the sheet and on power coupling. If the sheet width exceeds one-half the wave-length of the frequency used, a node (or series of nodes) of a standing wave results. Since there is no energy dissipation at a node, uneven heating results. Thus, the sheet width is preferably less than one-half of the wave length of the frequency used; and typically no wider than one quarter wavelength. Maximum frequencies preferred for several sheet widths are:

| Width | | |
|---|---|---|
| m | (in.) | MHz |
| 0.102 | 4.0 | 738 |
| 0.203 | 8.0 | 369 |
| 0.305 | 12 | 246 |
| 0.610 | 24 | 123 |
| 1.219 | 48 | 61.5 |
| 2.438 | 96 | 30.8 |
| 4.877 | 192 | 15.4 |

In the following examples, the dielectric heater used was a "Thermall" Model CCH/8.5 heater produced by W. D. LaRose & Associates, Inc., of Troy, N.Y. and rated at 8.5 kW operating at 84.2 MHz. Fixed electrodes wider than the samples treated were located beneath a variable-speed conveyor belt with a sheet of polytetrafluoroethylene between the belt and the electrodes. Each electrode (the first ground and the second "hot") extended transversely to the direction of belt-movement and was separated from the other along the direction of belt-movement by a variable amount. Unless specified otherwise, the latter spacing was approximately 7.6 cm. Such an arrangement of electrodes relative to the object to be heated produces what is called a fringing field.

As is well-known, polar dipoles within a material try to align with an applied electric field which, when oscillated at high frequency, produces internal heat due to rotation of the polar dipoles. One form of the classical equation for power developed in an oscillating electric field is $$P/v = 2\pi f \epsilon_o \epsilon_r'' E_{rms}^2$$

where

P/v is power developed in the material ($W/cm^3$)

f is frequency (Hz)

$E_{rms}$ is electric field strength in the material (Vrms/cm)

$\epsilon_r''$ is relative dielectric loss factor of the material ($\epsilon''/\epsilon_o$)

$\epsilon''$ is absolute dielectric loss factor of the material $\epsilon_o$ is free-space permittivity (F/cm).

Thus, the power density developed in the material depends on the frequency, the relative dielectric loss factor of the material, and the square of the electric field strength produced in the material. Electrical effects other than dipole oscillation may also contribute to heating.

The water in the sample being heated couples more or less effectively depending on the identities and concentrations of impurities. Very poor coupling results at lower frequencies as in the Examples when distilled water is used. Good coupling results when ordinary tap water or industrial water is used. Extraordinary coupling is known to and does result when detergents and/or wetting agents ar added to the water.

FIG. 1 is a scanning electron micrograph (taken at 20× magnification) of a cross-section of an unembossed expanded sheet of the invention showing multiple interleaved expanded macroscopic cells 10 throughout its thickness formed by membranous elements of fibrids 12 arranged in paper-like layers and containing numerous short fibers 14 (seen as straight white lines).

Figure 2:
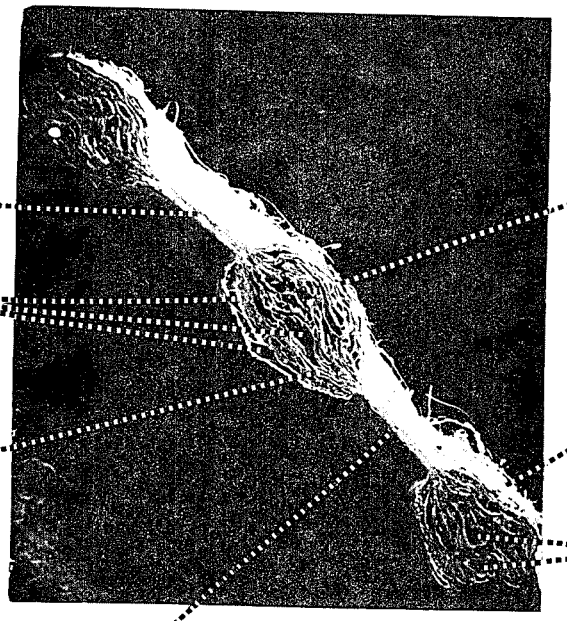
FIG. 2 is an enlarged cross-sectional view of a nonwoven sheet of the invention which is expanded only in discrete areas.

FIG. 2 is a scanning electron micrograph (taken at 10× magnification) of a cross-section of an expanded, embossed sheet of the invention. Expanded portions 8 contain many interleaved macroscopic cells 10 formed by a network of membranous elements of fibride 12 arranged in paper-like layers. The expanded portions 8 are separated by thinner portions 16 caused by embossing of the sheet prior to expansion.

Figure 3:
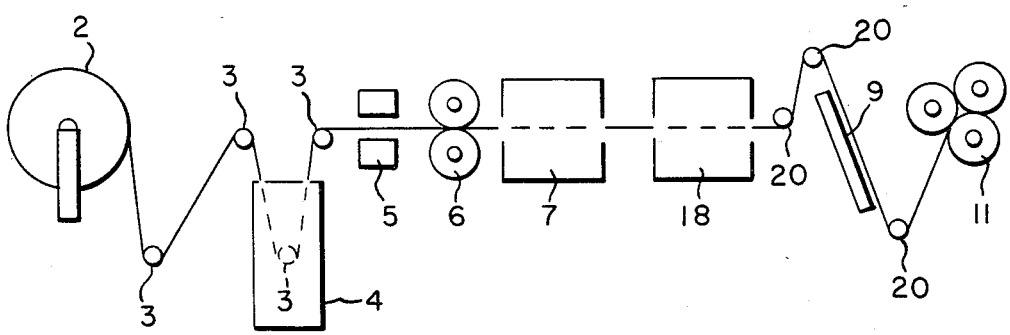
FIG. 3 is a diagrammatic illustration of one means for carrying out the process of the invention.

FIG. 3 illustrates one embodiment of the process of the present invention wherein a wet-formed nonwoven sheet comprised of wholly synthetic polymer fibrids and short length fibers containing at least 40% water at all times since its formation is taken from roll 2, passed around rollers 3 into wetting tank 4 where additional water is added to the sheet, the moisture content of the sheet is monitored with moisture meter 5, the sheet is embossed between matching patterned steel rolls 6 and passed between electrodes of dielectric heater 7 wherein the sheet is expanded. The sheet may be further dried and/or heat set in infrared oven 18, passed through an inspection stand 9 around additional rollers 20 onto wind-up roll 11. The expanded sheet may be simultaneously slit while being wound up Heat treatment of the expanded sheets for stabilization against shrinkage at elevated temperatures of use is often desirable. The floc normally employed will have been heat-set by heating at or above its polymer glass-transition temperature before being combined with fibrids and wet-laid; so it will not shrink appreciably. The fibrid polymer, however, must be essentially unoriented and uncrystallized before wet-laying, which can result in shrinkage of the expanded sheets at elevated use temperatures, especially when the fibrids comprise more than 85% by weight of the total fibrid-floc content. Below 85 wgt % of MPD-I fibrids, linear shrinkage is usually less than or about 5% decreasing to essentially 0% at and below 20 wgt % fibrids, at temperatures at about the glass-transition temperature of the fibrids. At subsequent use-temperatures below the glass-transition temperature, shrinkage is substantially zero. For the poly(m-phenylene isophthalamide) fibrids, heat-setting temperatures are usually 265°–270° C.

Tests

Basis weight is determined by weighing a dry sheet sample of known area and converting the result mathematically to the appropriate units of weight per unit area.

Thickness of a sheet is measured using a caliper (0 load on sample) and converting the result mathematically, if necessary, to the appropriate units for calculating density.

Density is computed as the basis weight divided by the thickness of a sheet, with appropriate conversion of units to provide the units g/mL. For sheets which have embossed unexpanded areas, the thickness of the most highly expanded portions of the sheet is used in computing apparent density, i.e., the density the sheet would have if no areas had been embossed and all areas had been allowed to expand uniformly to the same maximum degree. Whether embossed or unembossed, sheet thickness is measured perpendicularly to the plane of the sheet; thus, pleating or folding of the sheet to further increase its space-filling capability has no effect on the calculated apparent density. Likewise, basis weight is the weight per unit area of the planar sheet which, within the limitation of the art of wet-laid paper-formation; is uniform. In order to define a density specification inclusive of all sheets herein, the term "apparent density" is applied to all calculated densities as described above.

Tensile strength is measured on 2.54 cm wide samples clamped between 5.08 cm-spaced jaws of an Instron tensile tester according to ASTM-D-828-60 with elongation at 50%/min. The sample is conditioned at least 8 hours at 21° C. (70° F.). and 65% Relative Humidity before testing.

EXAMPLE I

Poly(m-phenylene isophthalamide) (MPD-I) fibrid/-floc handsheets were prepared at varying fibrid/floc weight ratios. All ratios and percentages reported are based on weight. Table I characterizes preparative conditions and the handsheets obtained. Column A designates composition of a volume of never-dried fibrids in tap water. Column B does the same for a slurry of floc in tap water. Volumes A and B were added to a blender and after blending, a portion, C, was taken and blended with an additional volume of tap water, D. A 1200 mL aliquot of the resultant blend was formed into a handsheet which, as collected, contained the indicated % water. The last column indicates the fibrid/floc weight ratio.

Table II reports the procedures involved first in diamond-embossing and then in dielectric heating 20 cm×10 cm (8.0 in×4.0 in) sections cut from the above handsheets. Two similarly prepared items identified as I-C′ and I-D′ are also incorporated. In Table II, $W_1$, $W_2$, and $W_3$ are, respectively, the sample weights before embossing, after embossing, and after dielectric heating. "Time in dielectric field" denotes the time required for each increment of sample to pass from one to the other electrode on the conveyor belt operated at the indicated speed. The expanded samples were dried at 150° C. after which thicknesses at essentially zero contact pressure were measured both at crests (thickest expanded portions) and nodes (thinnest embossed portions). Dry-weight of each sample is the last column. Pressures utilized in embossing were not measured, but were adequate and at least as great as subsequently determined to be workable. As can be seen from examination of node thicknesses, some expansion occurred at the nodes at fibrid percentages of about 85 or greater; and this minor expansion was visible as tiny bubbles. The integrity of the nodes was not, however, impaired. Test sheet I-J contained no fibrids. While it was possible to form and treat the handsheet, it became, during dielectric heating, only a loose mat of fibers without structural integrity and without embossed nodes.

Table III provides additional sheet properties. The thicknesses are of handsheets before embossing and dielectric heating and are useful in comparing with the crest and node thicknesses of Table II. The basis weights, tensile strengths, and elongations were all measured on the embossed and expanded sheets dried at room temperature. Maximum tensile properties are seen to result at fibrid/floc weight ratios in the range 95/5 to 50/50. "Apparent density" is computed as space occupied by the expanded sheet between flat plates; i.e., it is computed from basis weight (Table III) and crest thickness (Table II):

$$\rho=(BW/t_c)\times 10^{-3}$$

where $\rho$=apparent density (g/mL)

BW=basis weight (g/m$^2$)

$t_c$=crest thickness (mm).

Scanning electron micrographs of expanded portions of a sheet cross section of Item I-A showed a macroscopic cell structure of membranous elements substantially as shown in FIG. 1 but without the short fibers. Cross sections of Items I-F and I-G show a layered structure of fibers, membranous elements and macroscopic cells somewhat like FIG. 1 but with many more fibers and a less complete network of the cells. A cross section of I-H shows a paper-like layered structure of fibers and fragmented membranous elements with substantially no membranous cell structure as in FIG. 1.

TABLE I

EXAMPLE I: HANDSHEETS FROM FIBRIDS AND FLOC OF MPD-I

| | A | | B | | C | D | Aliquot of C + D to | | Fibrid/ |
|---|---|---|---|---|---|---|---|---|---|
| Test | Fibrid (g) | Water (g) | Floc (g) | Water (g) | A + B (mL) | Additional water (mL) | sheet-former (mL) | % Water | Floc Ratio |
| I-A | 70 | 430 | 0 | 3500 | 1100 | 2000 | 1200 | 89 | 100/0 |
| I-B | 66.5 | 408 | 3.5 | 3500 | 1100 | " | " | 90 | 95/5 |
| I-C | 63 | 387 | 7.0 | 3600 | 1100 | " | " | 89 | 90/10 |
| I-D | 49 | 301 | 21 | 3700 | 1100 | " | " | 88 | 70/30 |
| I-E | 28 | 172 | 42 | 3800 | 1100 | " | " | 86 | 40/60 |
| I-F | 21 | 129 | 49 | 3900 | 1100 | " | " | 85 | 30/70 |
| I-G | 14 | 86 | 56 | 3900 | 1100 | " | " | 88 | 20/80 |
| I-H | 7 | 43 | 63 | 4000 | 1100 | " | " | 92 | 10/90 |
| I-I | 3.5 | 21.5 | 66.5 | 4000 | 1100 | " | " | 88 | 5/95 |
| I-J | 0 | 0 | 70 | 4000 | 1100 | " | " | 88 | 0/100 |

TABLE II

EXAMPLE I: EMBOSSING AND HEATING

| | | | | | | Time in dielectric | Belt | Thickness | | Dry |
|---|---|---|---|---|---|---|---|---|---|---|
| Test | Fibrid/ Floc Ratio | $W_1$ (g) | $W_2$ (g) | $W_3$ (g) | % $H_2O$ Evaporated | field (s) | Speed (m/min) | Crest (mm) | Node (mm) | Weight (g) |
| I-A | 100/0 | 44.6 | 39.0 | 27.6 | 33 | 11.5 | 0.4 | 4.6 | 0.56 | 4.8 |
| I-B | 95/5 | 41.8 | 38.0 | 25.8 | 36 | 11.5 | 0.4 | 4.6 | 0.66 | 4.2 |
| I-C | 90/10 | 34.0 | 32.8 | 18.7 | 48 | 11.5 | 0.4 | 4.3 | 0.66 | 3.8 |
| I-C′ | 80/20 | 34.0 | 31.2 | 16.1 | 56 | 11.5 | 0.4 | 5.2 | 0.36 | 3.6 |

TABLE II-continued

| EXAMPLE I: EMBOSSING AND HEATING | | | | | | | | | | |
|---|---|---|---|---|---|---|---|---|---|---|
| Test | Fibrid/ Floc Ratio | $W_1$ (g) | $W_2$ (g) | $W_3$ (g) | % $H_2O$ Evaporated | Time in dielectric field (s) | Belt Speed (m/min) | Thickness Crest (mm) | Thickness Node (mm) | Dry Weight (g) |
| I-D | 70/30 | 31.4 | 29.2 | 17.4 | 46 | 11.5 | 0.4 | 5.7 | 0.30 | 3.7 |
| I-D' | 50/50 | 29.5 | 27.7 | 8.8 | 83 | 11.5 | 0.4 | 3.8 | 0.36 | 5.0 |
| I-E | 40/60 | 25.9 | 25.4 | 11.4 | 64 | 11.5 | 0.4 | 3.5 | 0.28 | 3.6 |
| I-F | 30/70 | 28.1 | 27.6 | 11.2 | 70 | 11.5 | 0.4 | 3.7 | 0.36 | 4.2 |
| I-G | 20/80 | 32.0 | 30.6 | 10.8 | 74 | 11.5 | 0.4 | 5.6 | 0.30 | 3.8 |
| I-H | 10/90 | 28.3 | 26.1 | 9.1 | 74 | 11.5 | 0.4 | 2.4 | 0.33 | 3.2 |
| I-I | 5/95 | 26.0 | 24.2 | 7.1 | 81 | 11.5 | 0.4 | 2.3 | 0.25 | 3.0 |
| I-J | 0/100 | 31.2 | 24.9 | 11.2 | 65 | 11.5 | 0.4 | — | — | 3.9 |

TABLE III

| EXAMPLE I: ADDITIONAL SHEET PROPERTIES | | | | | | |
|---|---|---|---|---|---|---|
| | Handsheet Thickness | | Dry Expanded Sheet | | | |
| Test | Wet (mm) | Air dried (mm) | Basis Weight ($g/m^2$) | Tensile Strength ($(N/m)/(g/m^2)$) | Elongation (%) | Apparent Density (g/mL) |
| I-A | 2.7 | 2.4 | 441 | 8.3 | 3.6 | 0.097 |
| I-B | — | — | 264 | 16 | 6.1 | 0.057 |
| I-C | 1.7 | 1.5 | 254 | 11 | 5.1 | 0.059 |
| I-D | 1.8 | 1.4 | 220 | 14 | 5.6 | 0.039 |
| I-E | 2.0 | 1.5 | 210 | 7.2 | 2.7 | 0.060 |
| I-F | 2.5 | 2.3 | 234 | 7.8 | 2.9 | 0.063 |
| I-G | 2.5 | 2.3 | 180 | 3.6 | 1.8 | 0.032 |
| I-H | 2.8 | — | 159 | 2.3 | 1.8 | 0.066 |
| I-I | 2.0 | 1.8 | 159 | 1.3 | 1.4 | 0.069 |

EXAMPLE II

This example tests the effect of belt-speed in the dielectric heater on expansion achieved. Belt-speed determines the time during which a sample is exposed to heating.

The sheets for these tests were all prepared using a commercial Fourdrinier papermaking machine. Two sheets were made, one for each belt-speed series, differing only in percentage of water retained. Fibrids of MPD-I at about 0.5 weight percent in tap water were fed to one inlet port of a mixing "tee". A slurry of MPD-I floc at about 0.35 weight percent in tap water was fed to the other inlet port of the mixing "tee". Fibrid-to-floc weight ratio was 60/40. Effluent was fed to the headbox and then to the forming wire. The resultant sheet was passed over normal drying cans at a temperature reduced to result in a collected sheet of desired moisture content. The high-pressure calender rolls normally used in papermaking were completely by-passed.

In Table IV are presented data relevant to expansion by dielectric heating. The "% water" is of the sheet as prepared. $W_1$, $W_2$, and $W_3$ (as defined in Example I) are for the actual 10 cm×10 cm (4.0×4.0 in) specimens heated. "% water removed" is based on weights before and after dielectric heating ($W_2$ and $W_3$) and on dry weight. Diamond-embossing was performed at an unmeasured but ample pressure. "Dry weight" is weight measured after drying the embossed and expanded specimen at 150° C. Where two crest thicknesses are given, they represent a measured range.

On examination of Table IV it is apparent that good expansion occurred in each test. Longer times in the dielectric heater removed more water, but did not further expand the specimens. In fact, full expansion occurred in each case only a short distance past the first electrode, relative to total distance (7.6 cm) separating the electrodes.

The expanded portions of the sheets contained many expanded macroscopic cells of membranous elements similar to FIG. 2.

TABLE IV

| EXAMPLE II: EMBOSSING AND DIELECTRIC EXPANSION | | | | | | | | | | | |
|---|---|---|---|---|---|---|---|---|---|---|---|
| Test | Fibrid/Floc Weight Ratio | % Water | $W_1$ (g) | $W_2$ (g) | $W_3$ (g) | % Water Removed | Time in Heater (s) | Belt Speed (m/min) | Thickness Crest (mm) | Thickness Node (mm) | Dry Weight (g) |
| II-A | 60/40 | 83 | 23.5 | 20.7 | 9.4 | 68 | 11.5 | 0.4 | 3.8–4.6 | 0.25 | 4.1 |
| II-B | " | " | 24.4 | 23.2 | 17.0 | 33 | 4.6 | 1.0 | 5 | 0.25 | 4.4 |
| II-C | " | " | 23.1 | 21.6 | 17.8 | 22 | 3.3 | 1.4 | 4.0 | 0.25 | 4.1 |
| II-D | " | 73 | 7.6 | 7.0 | 2.8 | 84 | 11.5 | 0.4 | 3.0–3.8 | 0.25 | 2.0 |
| II-E | " | " | 7.3 | 6.7 | 4.5 | 46 | 4.6 | 1.0 | 3.8 | 0.25 | 2.0 |
| II-F | " | " | 8.0 | 7.3 | 5.4 | 37 | 3.3 | 1.4 | 3.4–3.8 | 0.25 | 2.2 |
| II-G | " | " | 7.9 | 7.3 | 6.1 | 23 | 2.2 | 2.1 | 3.4–3.8 | 0.25 | 2.1 |

EXAMPLE III

This example investigates the effect of different degrees of drying of the sheet as wet-laid. The sheets were prepared as described in Example II except that more intensive drying on the drying cans was used. All specimens cut to 20×10 cm. (8.0×4.0 in) were diamond-embossed before dielectric heating. They were also immersed in tap water to increase their water contents before dielectric heating.

Table V presents the relevant processing and thickness details. Headings have the same meanings as in Table IV except that: (1) under "% water", the first number refers to the sheet as removed from the papermaking machine, and the second number applies to the re-wetted sheet, and (2) the "crest thickness" measurements were all on the dried expanded sheets, double entries indicating ranges.

Specimens III-A, III-B, and III-E all expanded excellently and uniformly. Specimens III-C and III-D expanded very irregularly with some portions expanded little, if at all. This confirms the need for at least 40% by weight water retained in the wet-laid sheet as prepared for best results. Sample III-F (dried and re-wet before dielectric heating) showed very little expansion and considerable delamination along the embossed lines. The 0.38 mm (15 mil) thick uncalendered Nomex® T-411 aramid paper did not expand at all even though soaked in tap water for 64 hours.

TABLE V

EXAMPLE III: EMBOSSING AND HEATING

| Test | % Water | $W_1$ (g) | $W_2$ (g) | $W_3$ (g) | % Water Removed | Time in heater (s) | Belt Speed (m/min) | Thickness Crest (mm) | Thickness Node (mm) | Dry Weight (g) |
|---|---|---|---|---|---|---|---|---|---|---|
| III-A | 62–78 | 27 | 26 | 8.3 | 93 | 11.5 | 0.4 | 4.3 | 0.25 | 5.9 |
| III-B | 50–74 | 28 | 26 | 9.7 | 86 | 11.5 | 0.4 | 3.9 | 0.25 | 7.1 |
| III-C | 32–70 | 22 | 20 | 8.8 | 84 | 11.5 | 0.4 | 1.3–3.0 | 0.25 | 6.6 |
| III-D | 30–72 | 21 | 18 | 7.8 | 84 | 11.5 | 0.4 | 1.3–3.3 | 0.25 | 5.8 |
| III-E | 43–73 | 23 | 21 | 7.7 | 87 | 11.5 | 0.4 | 3.9 | 0.25 | 6.0 |
| III-F | 62–* | — | — | — | — | 11.5 | 0.4 | 1.3–3.8 | 0.38–0.51 | — |
| T-411 | ** | — | — | — | — | long | 0 | — | — | — |

*Dried first at 100° C.; then soaked in tap water.

**Commercial Nomex ® T-411 aramid paper which was soaked in tap water for 64 h, wiped dry, and then placed in the dielectric heater.

EXAMPLE IV

This example documents the relative effectiveness of tap water (IV-A) and distilled water (IV-B). Handsheets were prepared as in Example I. The IV-A handsheet contained 87% by weight water as prepared. The IV-B handsheet contained 89% by weight water. The fibrid/floc weight ratio was 60/40. Specimens of each 20×20 cm (8.0×8.0 in) were cut, diamond embossed, and subjected to dielectric heating.

Sample IV-A (tap water) weighed 61 g after embossing and 15 g after dielectric heating. About 88% of the water vaporized. Residence time in the heater was 30 seconds. Crest/node thicknesses were 3.6 mm/0.28 mm. An excellent and uniformly expanded sheet resulted.

Sample IV-B (distilled water) weighed 62 g after embossing and 43 g after dielectric heating. About 35% of the water vaporized. Residence time in the oven was 150 s. Crest/node thicknesses were 1.3 to 3.3 mm/0.28 mm. Very irregular and incomplete expansion resulted.

The water supplies used were characterized as to mineral content and results are shown below in parts per million. The notation "ND" designates "none detectable".

| | Na | K | Ca | Mg | Al | Cu | Fe | Si | P | S | Cl— |
|---|---|---|---|---|---|---|---|---|---|---|---|
| IV-A | 12 | 3.4 | 29 | 12 | ND | 0.2 | 1 | 4 | ND | 5 | 35 |
| IV-B | 1 | 1 | 1 | ND | ND | ND | ND | 1 | ND | ND | ND |

EXAMPLE V

This example shows the effect on expansion of added surfactant. Handsheets were prepared as described in Example I except that the fibrid/floc weight ratio was 57/43 and that, about 6 min after adding the 2000 mL of tap water to the blender, a 10 mL volume of a 33 weight percent aqueous solution of Product BCO (Du Pont tradename for its cetyl betaine surfactant) and a 5 mL volume of antifoaming agent (Dow Antifoam B) were added. After each never-dried sheet (% water shown in Table VI) was made, it was cut to 10×10 cm (4.0×4.0 in) size before diamond embossing and dielectric heating.

In Table VI, tests V-A to V-D are for sheets as just described. Tests V-E to V-I are for sheets equivalent except that no Product BCO and no antifoaming agent were added. By comparing the belt speeds and crest thicknesses, it is apparent that the additives enabled full expansion at the highest belt-speeds available, but that control tests V-H and V-I reached less than full expansion at a belt-speed somewhat less than the maximum available.

TABLE VI

EXAMPLE V - EMBOSSING AND DIELECTRIC HEATING

| Test | Water % | $W_1$ (g) | $W_2$ (g) | $W_3$ (g) | Time in Heater (s) | Belt Speed (m/min) | % Water Vaporized | Thicknesses Crest (mm) | Thicknesses Node (mm) | Dry Weight (g) |
|---|---|---|---|---|---|---|---|---|---|---|
| V-A | 90 | 23.5 | — | 15.6 | 4.4 | 0.4 | — | 5.6 | 0.38 | 2.4 |
| V-B | " | 24.5 | 19.8 | 17.3 | 2.6 | 1.77 | 14 | 3.3–3.6 | 0.38 | 2.4 |
| V-C | " | 23.6 | 18.9 | 17.4 | 2.6 | 1.77 | 9 | 3.3–3.6 | 0.38 | 2.4 |
| V-D | " | 19.2 | 16.8 | 13.7 | 1.7 | 2.68 | 21 | 5.1 | 0.25–0.36 | 2.1 |
| V-E | 89 | 21.3 | 18.2 | 4.3 | 11.5 | 0.40 | 87 | 4.6–5.1 | 0.25–0.36 | 2.3 |
| V-F | " | 21.4 | 17.6 | 10.9 | 5.3 | 0.85 | 44 | 5.1 | 0.28–0.36 | 2.3 |
| V-G | " | 18.1 | 16.8 | 12.4 | 4.4 | 1.04 | 30 | 4.6 | 0.25–0.30 | 2.0 |
| V-H | " | 18.0 | 16.3 | 14.9 | 2.6 | 1.77 | 10 | 1.8–2.3 | 0.25–0.58 | 2.0 |
| V-I | 88 | 22.0 | 19.2 | 17.6 | 2.6 | 1.77 | 10 | 2.8 | 0.30–0.38 | 2.6 |

EXAMPLE VI

This example describes the preparation and dielectric heating of handsheets wherein some or all of the MPD-I floc is replaced by poly(p-phenyleneterephthalamide) (PPD-T) floc. The handsheets were prepared using the procedure of Example I.

PPD-T pulped floc was used as a 37 percent by weight suspension in water. Three handsheets were made having MPD-I fibrids/MPD-I floc/PPD-T pulped floc in parts by weight (dry weight basis):

57/38.4/4.6,
57/33.6/9.4, and
57/28.6/14.4, respectively.

Water content of the wet sheets was 86–87% by weight. All were diamond-embossed and passed through the dielectric heater at 0.4 m/min. All three expanded sheets were essentially identical with crest thicknesses in the range 4.2 to 4.8 mm and node thicknesses of about 0.25.

A handsheet of MPD-I fibrids/MPD-I floc/PPD-T floc (60/35/5) was 1.1 mm thick as prepared and contained 85% by weight water. After diamond-embossing, it was passed through the dielectric heater at 0.4 m/min. It expanded immediately to crest/node thicknesses of 4.6 mm/0.25 mm. Dry basis weight was 193 g/m$^2$. The PPD-T floc of this and the next sheet was cut from tow of Kevlar ® 29 aramid yarns (Du Pont).

A handsheet of MPD-I fibrids/PPD-T floc (50/50) was prepared using only PPD-T floc; i.e., all the MPD-I floc was substituted with PPD-T floc. Preparation, embossing, and dielectric heating were as described for the previous test. The crest/node thicknesses were 3.0 mm/0.25 mm, and the dry basis weight was 166 g/m$^2$. The expanded portions of the sheets contained many expanded macroscopic cells of membranous elements similar to FIG. 2.

EXAMPLE VII

This example shows expanded sheets prepared from MPD-I fibrids and glass floc in a 57/43 weight ratio. The glass floc was 3.2 mm (0.125 in) long and 8 $\mu$m diameter glass staple obtained from Pittsburgh Plate Glass. The handsheet was made following the general procedure of Example I. It was diamond-embossed and then passed through the dielectric heater at 0.4 m/min. Expansion was immediate providing crest/node thicknesses of 3.0–3.3 mm/0.23–0.25 mm. The expanded portions of the sheets contained many expanded macroscopic cells of membranous elements similar to FIG. 2. When the dried expanded sheet was held in the flame of a laboratory burner, very little shrinkage occurred.

EXAMPLE VIII

This example illustrates the use of a thermoplastic polymer for the fibrid and/or the floc components. The thermoplastic polymer employed was poly(ethylene terephthalate) for which the abbreviated name 2G-T is used hereafter.

2G-T Fibrids

The 2G-T polymer used in preparing fibrids had a relative viscosity (LRV) of 22 where: (1) LRV is the ratio at 25° C. of the flow times in a capillary viscometer for solution and solvent, (2) the solution is 4.75 weight percent polymer in solvent, and (3) the solvent is hexafluoroisopropanol containing 100 ppm of $H_2SO_4$.

Fibrids were prepared by trickling 200 mL of a 10% (w/w) solution in trifluoroacetic acid of the above polymer into 300 mL of water while stirring rapidly in a blender. The fibrids obtained were washed in tap water until the effluent had a pH of 4. The final aqueous slurry was 29% by weight fibrids.

2G-T Floc

The 2G-T floc employed was of Dacron ® Type 54 polyester staple with a cut length of 6.35 mm (0.25 in) and a linear density per filament of 1.67 dtex (1.5 denier).

2G-T Fibrid/2G-T floc (60/40)

Into a blender containing 3.5 L of tap water were added 148 g of the above 2G-T fibrid slurry and 30 g of 2G-T floc. After blending for 15 min, 1100 mL of the mixture was added to 2 L of tap water, and the new slurry was blended for 10 min. A 1200 mL aliquot of the final mixture was added to the headbox of a 20 cm×20 cm (8.0×8.0 in) laboratory sheet former. The wet sheet removed after pulling vacuum for about 25 seconds comprised about 89% water.

The above sheet (74.4 g) was diamond-embossed, resulting in loss of weight to 65.8 g. The embossed sheet was dipped into water containing 0.83% cetyl betaine (Product BCO—Du Pont) whereupon its weight increased to 74.1 g. Upon passage of the wet, embossed sheet through the dielectric heater at 0.4 m/min, expansion of the unembossed areas was rapid. Weight of the sheet after expansion was 10.1 g. Another pass through the heater removed the remaining water, reducing the sheet weight to 7.8 g (184 g/m$^2$). Crest/node thicknesses were 6.4 mm/0.25–0.37 mm.

2G-T Fibrid/MPD-I Floc (60/40)

In a blender originally containing 3.5 L of water were blended for 15 min 30 g of MPD-I floc and 225 g of an aqueous slurry of 2G-T fibrids prepared as described above at 19.5% solids. An 1100 mL aliquot of the resulting mixture was added to 2 L of tap water and blended for 10 min. A 1200 mL aliquot of the final mixture was converted to a 20 cm×20 cm (8.0×8.0 in) handsheet, as above, to form a wet handsheet of 87% water.

The wet handsheet, after diamond-embossing, was passed through the dielectric heater at 0.4 m/min. Resultant crest/node thicknesses were 4.3 mm/0.25 mm.

The expanded portions of this sheet, as well as of the above all 2G-T fibrid/floc sheet, contained paper-like layers of membranous elements and scattered expanded macroscopic cells.

EXAMPLE IX

This example describes the preparation of MPD-I fibrid/MPD-I floc sheets which were dielectrically heated without any embossing to provide very low densities.

Wet sheets containing about 83% water were prepared using a commercial Fourdrinier machine. The wet sheet was about 1.14 mm (0.045 in) thick, and the fibrid/floc weight ratio was 60/40. Unlike the customary papermaking process on this machine, the dryer rolls were operated at sufficiently low temperatures to prevent complete removal of water, and the wet-laid sheet was not calendered.

From the above product, specimens 20 cm×10 cm (8.0 in×4.0 in) were cut. Before exposure to dielectric heating, each was dipped in an aqueous detergent solution for a given time, and then wiped dry. Two dips used contained cetyl betaine (Product BCO-Du Pont) at 0.83 and 1.65%, respectively. These were prepared by diluting 2.5 and 5.0 g, respectively, of 33 weight percent Product BCO with water until the solution weighed 100 g. The other two dips were of 2.5 and 7.5 weight percent LPS ® Lotion Soap (Calgon) in water. Columns headed "% BCO" and "% LPS ®" in Table VII identify these dips, and the column labeled "Soak Time" identifies the length of time each specimen remained in the specified dip. The expanded specimens were quite irregular in thickness. "Expanded thickness" in Table VII is an average value; so the calculated "Volume" and "Density" are approximate.

While the dried, expanded sheets of Table VII could relatively easily be separated into thinner layers, they had sufficient structural integrity to permit handling, cutting, shaping, etc. without layer separations. They are well-suited for use as flame-retardant thermal or acoustic insulation.

A scanning electron micrograph at 20× magnification of a cross section through a thickness of Item IX-A (see FIG. 1) shows a multiplicity of layered membranous elements which join with and separate from one another at random forming a highly irregular, three-dimensional network of numerous interleaved macroscopic cells with tapered edges throughout the thickness. The elements form a plurality of paper-like layers lying substantially horizontally in the plane of the sheet.

TABLE VII

EXAMPLE IX - UNEMBOSSED EXPANDED SHEETS

| Test | % BCO | % LPS ® | Soak Time (min) | Belt Speed (m/min) | Thickness (mm) | Dry Weight (g) | Volume (mL) | Density (g/mL) |
|---|---|---|---|---|---|---|---|---|
| IX-A | 0.83 | | 2.0 | 0.4 | 18 | 4.2 | 367 | 0.011 |
| IX-B | 0.83 | | 2.0 | 0.4 | 14 | 3.7 | 288 | 0.013 |
| IX-C | 0.83 | | 1.0 | 0.4 | 16 | 3.7 | 341 | 0.011 |
| IX-D | | 2.5 | 1.0 | 0.4 | 14 | 3.9 | 288 | 0.013 |
| IX-E | 1.65 | | 1.0 | 0.4 | 25 | 3.9 | 520 | 0.0074 |
| IX-F | 1.65 | | 2.0 | 0.4 | 25 | 4.4 | 520 | 0.0083 |
| IX-G | 1.65 | | 1.0 | 1.2 | 30 | 4.0 | 620 | 0.0062 |
| IX-H | | 7.5 | 1.0 | 0.8 | 33 | 4.0 | 690 | 0.0059 |

EXAMPLE X

This example illustrates plain embossing as described hereinbefore and the effectiveness of the expanded sheet for thermal insulation.

Using a slurry in water of 60 wgt % MPD-I fibrids and 40 wgt % MPD-I floc, a sheet was prepared using a paper-making machine. It had 17 wgt % solids (83 wgt % water) and had a dry basis weight of 208 g/m$^2$. A 20×20 cm (8.0×8.0 in) sample of the wet sheet was plain-embossed and then expanded by passage through the dielectric heater at 0.4 m/min. It expanded immediately to provide crest/node thicknesses of 2.5 mm/0.25 mm. The apparent density is calculated to be 0.083 g/mL. FIG. 2 is a scanning electron micrograph at 10× of a thickness cross-section of the product on a line maximizing the appearance of unexpanded embossed portions and showing the cell structure of the invention in the expanded portions. About 90% of the face area was expanded.

Seven of the expanded sheets were stacked to give a total thickness of 19 mm under 0.0138 kPa (0.002 lb/in$^2$) pressure (total area basis). Thermal conductivity at 25° C. was measured to be 0.035 W/m·K using the method described by J. L. Cooper and M. S. Frankosky in *Journal of Coated Fabrics,* Vol. 10, 107 (1980).

The expanded sheet of this example was heat-set unrestrained in a nitrogen atmosphere. Heating from ambient to 265° C. occurred over a 90 minute interval, and 265° C. was maintained for an additional 15 minutes. Linear shrinkage as a result of this treatment was about 5%, and the crests diminished in thickness by about 33%. From these shrinkages the apparent density after shrinking is calculated to be 0.137 g/mL. At subsequent exposures to temperatures of 240° C. or less, there was essentially no shrinkage.

EXAMPLE XI

This example describes various sheets prepared using fibrids made from commercially available polyvinylidene fluoride, PVF, polymer (obtained from Pennwalt Corp., tradenamed "Kynar").

Fibrid Preparation

PVF fibrids were prepared using a tube fibridator comprising a tube of 6.35 mm (0.25 in.) inside diameter through the wall of which were provided along a restricted length 64 uniformly spaced holes 0.25 mm (0.01 in.) in diameter. An enclosure with a right-angle inlet surrounded the restricted length of tube. A 5% by weight solution of PVF in dimethylacetamide was pumped at 140 mL/min into the enclosure and through the holes into water flowing through the tube at 10 L/min. The PVF fibrid slurry was drained and was found to hold 69% by weight water (31% solids).

PVF Fibrids/MPD-I Floc (50/50)

The above PVF fibrid slurry was diluted with water to 12% by weight solids and 402 g of diluted stock, together with 35 g of MPD-I floc, was added to a blender and blended with an additional 3600 mL of water for 15 min. Then, 1100 mL of the mixture was blended 10 min with 2 L of water before being converted to a handsheet as previously described. The wet handsheet was diamond-embossed and passed through the dielectric heater at 0.4 m/min. Expansion was rapid, providing crest/node thicknesses of 3.0 mm/0.30 mm. Inspection of cross-sections of crests with a scanning electron microscope showed evidence of fusion of the fibrids, but there was no loss in integrity of the expanded sheet. The L.O.I. (limiting oxygen index) for the dried sheet was 0.30. L.O.I. is the minimum fraction of oxygen in an oxygen/nitrogen mixture which is required to barely support combustion of a sample. See Fenimore & Martin, *Modern Plastics,* Vo. 44 (3), 141 (1966). Apparent density was 0.063 g/mL.

Examination of a cross-section of the sheet revealed that it comprised a plurality of paper-like layers of membranous elements joining and separating at random to define expanded macroscopic cells.

PVF Fibrids/PTFE Floc (25/75)

In a blender containing 3.0 L of tap water were blended 16.6 g of 6.35 mm long floc of poly (tetrafluoroethylene), PTFE, for 2.5 minutes. Then 0.6 g Triton X-100 surfactant and 1.0 ml of Antifoam B were added and the slurry was blended for an additional 30 sec. In a separate operation, enough PVF fibrid slurry to provide 5.5 g of fibrids on a dry-weight basis was placed in 3 L of tap water in a blender and was blended for 30 sec. To this were added 1.2 ml of 10% Aerosol OT solution (wetting agent) and 1.0 ml Antifoam B and blended for an additional 15 sec. Three batches of both the floc and fibrid slurries were transferred to the headbox of a 33×33 cm (13×13 in) sheet mold and the volume was increased to about 20 liters by adding tap water. The dispersion was agitated and full vacuum was applied quickly. The sheet was actually collected on a nonwoven sheet of poly(ethylene terephthalate) weighing 67.9 g/m$^2$ (2 oz/yd$^2$). It was pulled off the collecting sheet and found to comprise about 70% by weight water and had a dry basis weight of 543 g/m$^2$ (16 oz/yd$^2$).

Two 10×10 cm (4.0×4.0 in) specimens of the sheet were prepared. One was dried in a vacuum oven at 100° C. after which its thickness was 0.15 cm (0.060 in). The other was passed through a dielectric heater at 0.4 m/min. Its expanded thickness was 0.76 cm (0.30 in). Apparent density was measured at about 0.10 g/mL. The cross-section of the sheet was composed of a plurality of paper-like layers of membranous elements joining and separating at random to define expanded macroscopic cells.

PVF Fibrids/PTFE Floc/Glass Floc (25/50/25)

A handsheet was prepared as described above except that one-third by weight of the PTFE floc was replaced with 6.35 mm long ETDE glass floc with a diameter of 6.25 μm. (ETDE is an Owens Corning designation wherein the first E means "electrical", the T means "textured", and DE specifies diameter.) A specimen cut from never-dried sheet was diamond-embossed and then passed through the dielectric heater at 0.4 m/min. Resultant crest/node thicknesses were approximately 3.3 mm/0.25 mm. Apparent density was measured as 0.07 g/mL. The cross-section of the sheet was composed of a plurality of paper-like layers of membranous elements joining and separating at random to define expanded macroscopic cells. Dimensional stability of the expanded product was evaluated by holding it in the flame of a laboratory burner and observing very little shrinkage.

EXAMPLE XII

This example demonstrates the use of a reinforcing scrim in an expanded sheet of the invention.

Over the 8.0×8.0 inch (20×20 cm) paper-forming area of a laboratory papermaking machine was placed an approximately 9.0×9.0 inch (23×23 cm) piece of a 25-mesh, 2.75 oz/yd$^2$ (93 g/m$^2$) scrim woven from commercial MPD-I, Nomex® aramid, yarns (Style 600 by the Libbey Co.). After establishing a 1.27 cm head of water in the headbox, a 600 mL aliquot of a slurry of MPD-I fibrids and floc (57/43 fibrid/floc weight ratio) was added and water vacuum was pulled for 25 seconds. Then the scrim-containing handsheet was turned over and another 600 mL of slurry pulled onto the other face of the scrim by application of water vacuum for 25 seconds. The wet composite was stored temporarily in a polyethylene bag to prevent drying.

The slurry used above was prepared in a blender by first adding a slurry of MPD-I fibrids containing 40 g of fibrid and 460 g of water and then adding 30 g of 2.0 denier per filament floc dispersed in 3500 mL of water. After blending the mixture for 30 min, a 1000 mL aliquot was diluted with 2000 mL of water and further stirred for 15 min, thus yielding the final slurry.

The temporarily stored wet sheet was removed from its polyethylene bag and passed through the 84.2 MHz dielectric oven at 1.3 ft/min (0.4 m/min). Expansion occurred as if no scrim were present, but the scrim was firmly anchored in the mid-plane of the expanded sheet-structure which, in cross-section, was seen to be composed of a plurality of paper-like layers of membranous elements joining and separating at random to define expanded macroscopic cells. Two 1 inch (2.5 cm) wide samples were tested in a laboratory tensile tester using 1 inch (2.5 cm) gauge length. Basis weight for the structure was 8.2 oz/yd$^2$ (278 g/m$^2$), elongation at break averaged 39%, and averaged tensile strength was 35.3 lb (77.6 kg).

Similar scrim-reinforced expanded sheets were prepared by depositing slurry on only one side of the scrim during paper-forming. Also, wet preformed but unexpanded sheets were placed on one or both faces of a scrim, embossed as described hereinbefore, and then expanded by dielectric heating to provide reinforced integral sheet structures.

EXAMPLE XIII

This example demonstrates the use of soluble inorganic salts as additives for improving coupling with the dielectric field during expansion in a dielectric heater.

A never dried sheet equivalent to the starting sheets of Examples II-A, II-B, and II-C was prepared with a uniform thickness of 1.14 mm (0.045 in.) and a basis weight of 177 g/m$^2$. A strip 83.5 cm (32.9 in.) long and 14.0 cm (5.50 in.) wide was cut from the sheet, and the strip was soaked for about one minute in water containing 200 ppm by weight of $Na_2SO_4$. The strip was then sandwiched between lightweight sheets of screening prepared from glass yarns coated with polytetrafluoroethylene, and the sandwich was passed through the 84.2 MHz dielectric oven at 0.40 m/min (1.3 ft./min.). Expansion was rapid to a uniform thickness of 1.0 cm (0.39 in.). As a result of expansion and drying, the strip shrank about 4% in both the width and length dimensions. Apparent density of the dry sheet was 0.019 g/mL. Examination of its cross-section revealed that it was composed of a plurality of paper-like layers of membranous elements joining and separating at random to define expanded macroscopic cells.

The white expanded strip was aged for 8 days in an air-oven at 220° C. Its surfaces underwent slight darkening equivalent to that occurring when a similar sheet prepared without any $Na_2SO_4$ additive is aged identically. In contrast, a sheet identically prepared except for using cetyl betaine (product BCO detergent by Du Pont, as disclosed in Example IX) in place of $Na_2SO_4$ turned distinctly brown on aging at 220° C. for 8 days.

Where discoloration is of no consequence, organic detergents and wetting agents are excellent coupling agents for dielectric heating. If retention of whiteness is important, use of a soluble inorganic salt is preferred. Substantially all soluble inorganic salts are effective.

Because of low cost and availability, the simpler Na and K salts such as NaCl, KCl, $Na_2SO_4$, $K_2SO_4$, etc. are preferred.

I claim:

1. Process for preparing a coherent expanded adhesive-free wet laid nonwoven sheet comprised of fibrids of a wholly synthetic polymer and optionally up to 80% by weight floc, the sheet having an apparent density of less than 0.16 g/mL and being comprised of a plurality of paper-like layers of membranous elements which join and separate at random throughout the thickness of the sheet to form expanded macroscopic cells, the expanded sheet further comprising up to 50%, based on the total area of the sheet, of discrete areas which are not expanded, the process comprising preparing a wet mixture of fibrids of a wholly synthetic polymer, and optionally up to 80% by weight floc, forming a wet-laid nonwoven sheet of the fibrids on paper-forming equipment, maintaining water in the sheet, adding additional water if needed to increase the water content of the sheet to at least 60% by weight, and heating the wet sheet under such pressure and for such time to vaporize the water rapidly and, simultaneously, to expand the wet-laid nonwoven sheet to provide the aforesaid expanded sheet.

2. Process of claim 1 wherein the water content is maintained at at least 40% by weight.

3. Process of claim 2 wherein up to 50% of the total area of the sheet is embossed before expansion to provide a sheet which is expanded only in unembossed areas.

4. Process of claim 2 wherein the wet nonwoven sheet contains 20–80% by weight fibrids and complementally 20–80% by weight floc on a dry basis.

5. Process of claim 2 wherein the wet nonwoven sheet contains 50–80% by weight fibrids and 20–50% by weight floc on a dry basis.

6. Process of claim 2 or 3 wherein the fibrids are comprised of an aromatic polyamide.

7. Process of claim 6 wherein the fibrids are poly(m-phenylene isophthalamide).

8. Process of claim 2 wherein aromatic polyamide floc is used.

9. Process of claim 8 wherein poly(m-phenylene isophthalamide) floc is used.

10. Process of claim 8 wherein poly(p-phenylene terephthalamide) floc is used.

11. Process of claim 10 wherein the poly(p-phenylene terephthalamide) floc is pulped.

12. Process of claim 1, 2 or 3 wherein the rapid vaporization of water is induced by dielectric heating.

13. Process of claim 1 wherein the sheet after expansion is heated at about the glass transition temperature of the fibrids.

14. Process of claim 2 wherein the sheet is embossed and expanded simultaneously in a single operation to expand only predetermined areas of the sheet.

15. Process of claim 1, 2 or 3 wherein the wet mixture contains floc and the fibrids comprise more than 30% by weight of the two.

16. A coherent expanded adhesive-free wet laid nonwoven sheet comprised of fibrids of a wholly synthetic polymer which fibrids form a multiplicity of layered membranous elements which join with and separate from one another at random to form a three-dimensional, highly irregular network of numerous interleaved macroscopic cells with tapered edges positioned substantially throughout the thickness of the expanded sheet, said sheet having an apparent density of less than 0.16 g/mL, the expanded sheet further comprising up to 50%, based on the total area of the sheet, of discrete areas which are not expanded.

17. An expanded wet laid nonwoven sheet of claim 16 comprised of 50–80% by weight fibrids and 20–50% by weight floc based on dry weight.

18. An expanded wet laid nonwoven sheet of claim 17 wherein both the fibrids and the floc are comprised of an aromatic polyamide.

19. An expanded wet laid nonwoven sheet of claim 18 wherein the thickness of expanded areas is at least 10 times greater than that of the unexpanded areas.

20. An expanded wet laid nonwoven sheet of claim 18 having an apparent density of less than 0.10 g/mL.

21. An expanded nonwoven sheet of claim 16 containing floc mixed with the fibrids and the fibrids comprise more than 30% by weight of the two.

22. An expanded wet laid nonwoven sheet of claim 16 wherein the fibrids are comprised of polyvinylidene fluoride.

23. An expanded wet laid nonwoven sheet of claim 22 comprised of floc of poly(tetrafluoroethylene).

24. An expanded nonwoven sheet of claim 16 or 8 comprising a reinforcing scrim as an integral part thereof.

25. An expanded wet laid nonwoven sheet of claim 16 containing 20–80% by weight fibrids and complementally 20–80% by weight floc, each not melting below 130° C.

26. An expanded wet laid nonwoven sheet of claim 16 wherein the fibrids are comprised of an aromatic polyamide.

27. An expanded wet laid nonwoven sheet of claim 26 wherein the fibrids are of poly(m-phenylene isophthalamide).

28. An expanded wet laid nonwoven sheet of claim 25 wherein at least some of the floc has been pulped.

29. An expanded nonwoven sheet of claim 26 containing floc which is comprised of an aromatic polyamide.

30. An expanded wet laid nonwoven sheet of claim 29 wherein the floc is of poly(m-phenylene isophthalamide).

31. An expanded wet laid nonwoven sheet of claim 29 wherein the floc is of a crystalline aromatic polyamide.

32. An expanded wet laid nonwoven sheet of claim 31 wherein the floc is of a crystalline poly(m-phenylene isophthalamide).

33. An expanded wet laid nonwoven sheet of claim 31 wherein the floc is of poly(p-phenylene terephthalamide).

34. An expanded nonwoven sheet of claim 27 containing floc of glass fibers.

35. An expanded wet laid nonwoven sheet of claim 17 which has an apparent density of less than 0.10 g/mL.

* * * * *